US007114725B2

(12) United States Patent
Camp et al.

(10) Patent No.: US 7,114,725 B2
(45) Date of Patent: Oct. 3, 2006

(54) ROTARY SHOOTING TARGET

(75) Inventors: Scott A Camp, Addison, IL (US); Steven A Camp, Addison, IL (US)

(73) Assignee: Better Bilt Products, Inc., Addison, IL (US)

( * ) Notice: Subject to any disclaimer, the term of this patent is extended or adjusted under 35 U.S.C. 154(b) by 0 days.

(21) Appl. No.: 10/802,281

(22) Filed: Mar. 17, 2004

(65) Prior Publication Data

US 2005/0206085 A1 Sep. 22, 2005

(51) Int. Cl.
*F41J 5/14* (2006.01)

(52) U.S. Cl. ..... 273/390

(58) Field of Classification Search ..... 273/390–392, 273/406, 407, 349, 359, 368, 369; 416/9; 482/57, 62; 239/494
See application file for complete search history.

(56) References Cited

U.S. PATENT DOCUMENTS 157,335 A * 12/1874 Lyon ..... 273/388
1,629,386 A * 5/1927 Hummerson ..... 273/390
2,085,933 A * 7/1937 Vaughan ..... 273/388
2,691,526 A * 10/1954 Wesley et al. ..... 273/359
3,563,541 A * 2/1971 Sanquist ..... 482/51
3,690,664 A * 9/1972 Hauke et al. ..... 273/127 D
4,270,056 A * 5/1981 Wright ..... 290/54
4,588,194 A * 5/1986 Steidle et al. ..... 273/391
6,478,301 B1 * 11/2002 Witmeyer ..... 273/391
6,557,855 B1 * 5/2003 Wu ..... 273/369
6,656,063 B1 * 12/2003 Prichard ..... 473/429

FOREIGN PATENT DOCUMENTS

DE 78756 * 4/1919

* cited by examiner

*Primary Examiner*—Mark S. Graham
(74) *Attorney, Agent, or Firm*—Leydig, Voit & Mayer, Ltd.

(57) ABSTRACT

A vertical rotary shooting target having a stand with a horizontally extending axial which supports a rotary target structure. The vertical rotary target structure includes a hub rotatably mounted on the axial, a pair of target impact plates, and a support structure connecting the impact plates radially outwardly on diametrically opposed sides of the said hub and in horizontally spaced relation for enhanced shooting difficulty. Alternative embodiments of impact plate support structures are disclosed which minimize potentially harmful and damaging splashback of bullets striking the impact plates.

14 Claims, 3 Drawing Sheets

ROTARY SHOOTING TARGET

FIELD OF THE INVENTION

The present invention relates generally to shooting targets for use with handguns, shotguns, and rifles, and more particularly, to a rotary shooting target that has a plurality of impact paddle-like plates which define continually moving targets in response to being struck by bullets during usage.

BACKGROUND OF THE INVENTION

Vertical rotary shooting targets are known which comprise a stand having a horizontal axle on which a hub is rotatably mounted from which support rods extend radially on diametrically opposed sides of the hub. Each radial support rod carries a target in the form of a paddle-like impact plate made of hardened steel fixed to a side thereof, with the impact plates being mounted on opposite lateral sides of the radial support rods. When a shooter sequentially hits the targets, the hub, support rods and impact plates rotate about the axis in a vertical plane, creating rapidly moving targets for rapid fire practice.

When a bullet hits the impact plate, a splash cone is created which can cause particles of handgun bullets to splash and deflect more than 20 yards and rifle bullets can deflect 75 yards and more. When the bullet strikes a vertical junction between the support rod and the impact plate affixed thereof, lateral and rearward splashback can occur which can strike shooters located downwardly along a firing line. Moreover, the splashback can strike and damage the hub, axle, and stand, which are not made of impact resistant hardened steel. Since the impact plate and hubs are welded to the connecting rod, which can create stress cracks in the joint area, the junction areas can be susceptible to failure after repeated impact, as is the case in rotating targets of such type which are used for rapid shooting practice.

OBJECTS AND SUMMARY OF THE INVENTION

It is an object of the present invention to provide a vertical rotary shooting target adapted for more effectively preventing harmful splashback of bullet fragments along a shooting line.

Another object is to provide a vertical rotary shooting target as characterized above which minimizes splashback of bullet fragments which can damage the stand and support structure in the rotary target.

A further object is to provide a vertical rotary target of the foregoing type which provides more challenging rapid fire practice in sequential shooting.

Still another object is to provide a vertical rotary shooting target of the above kind which is adapted for more economical construction and long-term reliable usage. A related object is to provide such a rotary target which eliminates the necessity for welding structural components of the rotary targets at locations where stress cracks can occur that are susceptible to failure during usage of the target.

Other objects and advantages of the invention will become apparent upon reading the following detailed description and upon reference to the drawing, in which:

Figure 1:
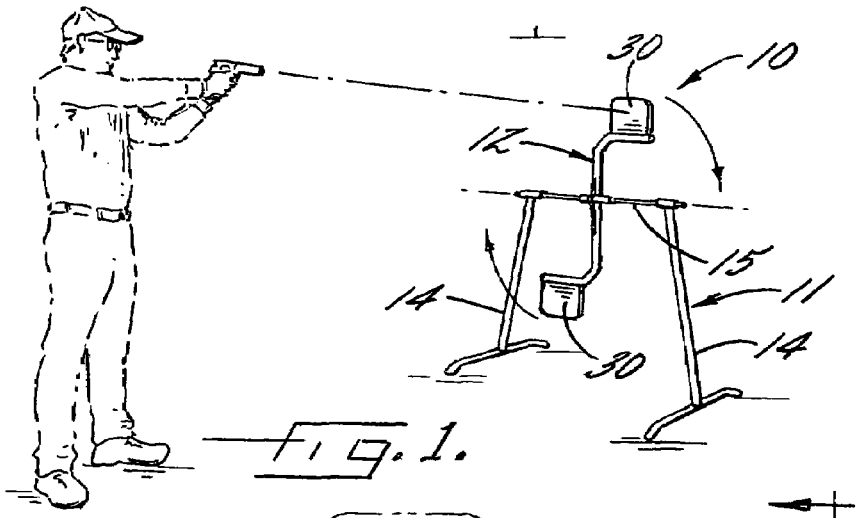
FIG. 1 is a perspective of an illustrative rotary target in accordance with the invention being used on a shooting line.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF PREFERRED EMBODIMENTS

Referring now more particularly to FIGS. 1–4 of the drawings, there is shown an illustrative vertical rotary target 10 embodying the present invention, comprising a conventional stand 11 and a rotary target support structure 12. The stand 11 in this instance comprises a pair of side legs 14 which support a horizontal axle rod 15. The legs 14 have respective collars 16 at their upper ends through which opposing ends of the axle rod 15 extend, with removable split pins 18 retaining the axle rod 15 in mounted position.

The rotary target support structure 12 comprises a hub 20 rotatably mounted centrally on the axle rod 15, and a pair of target support members in the form of rods 21 extending radially from diametrically opposed sides of the hub 20. The target support rods 21 in this instance are welded in a butting relation to opposite sides of the hub 20 and further retained by means of a pair of reinforcement support rods 22 each welded to respective ends of the support rods 21 on opposite sides of the hub. The hub 20 is maintained centrally on the axle rod 15 by pins 24, and an appropriate bushing may be provided between the hub 20 and axle rod 15 facilitating relative rotational movement of the hub 20. Hence, it can be seen that the target support structure 12 can be rotated relative to the axle rod 15.

Figure 2:
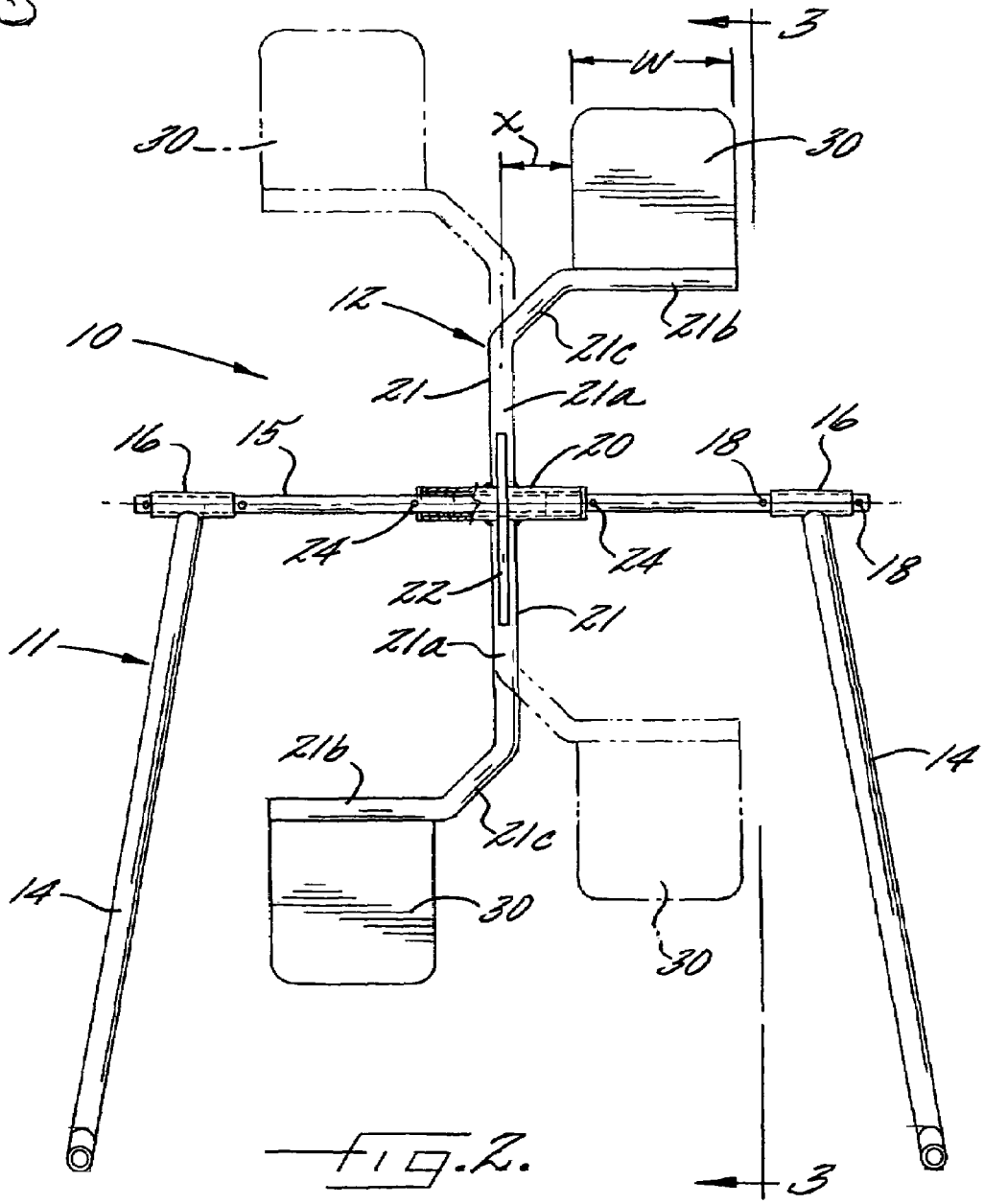
FIG. 2 is an enlarged front elevational view of the rotary target shown in FIG. 1.
Figure 3:
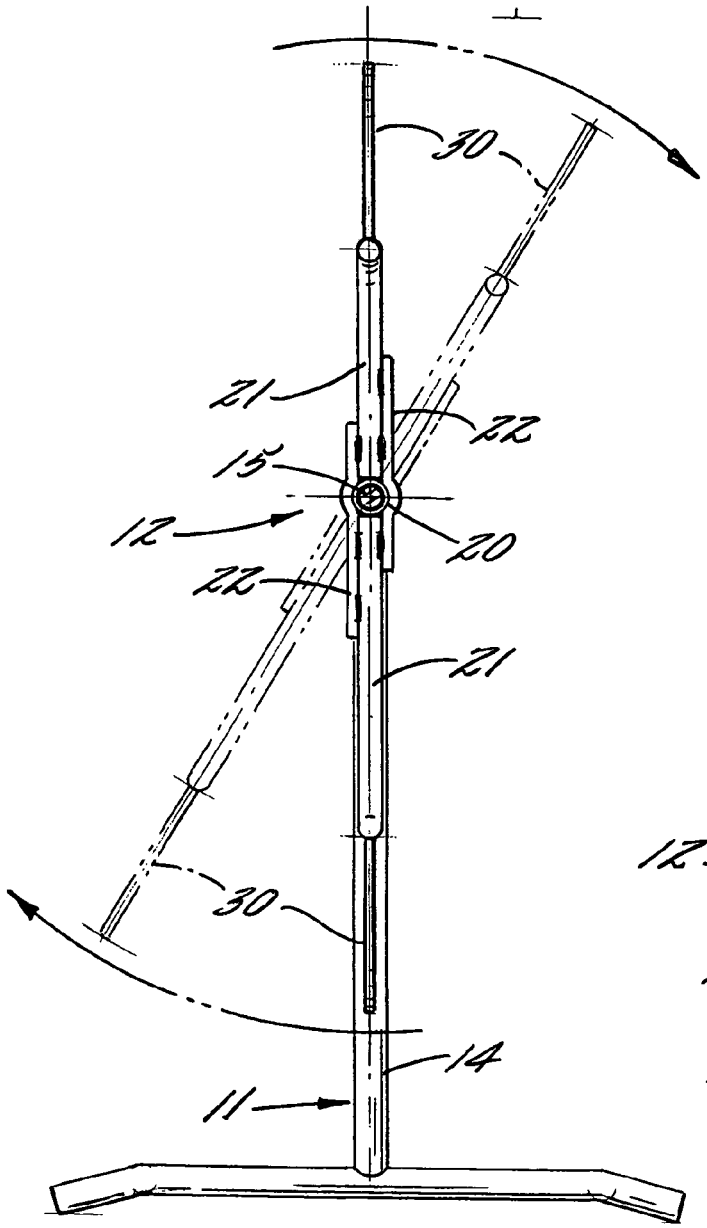
FIG. 3 is a vertical section of the illustrated rotary target taken in the plane of line 3—3 in FIG. 2.
Figure 4:
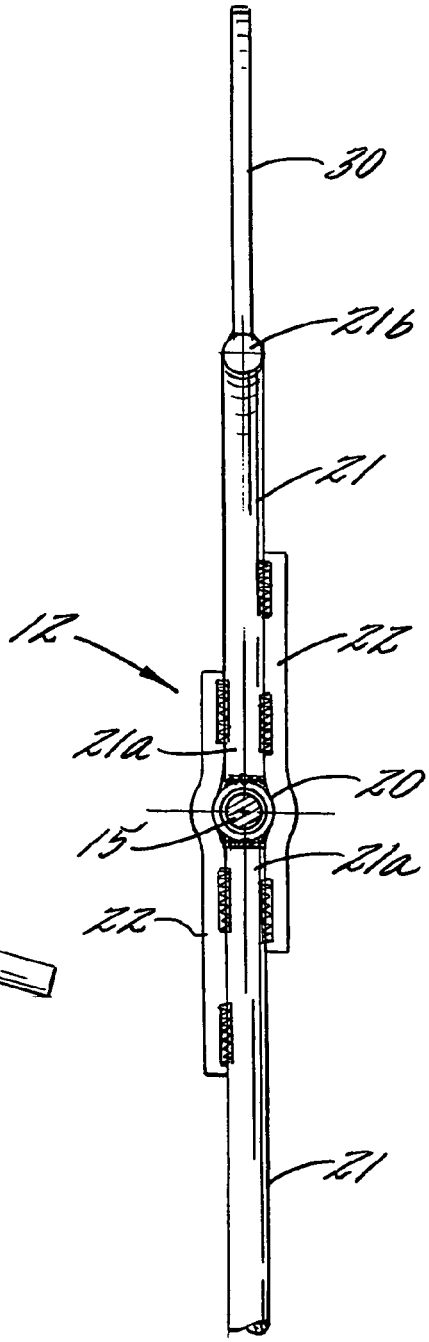
FIG. 4 is an enlarged fragmentary section showing the connection of impact paddle support rods to a rotary hub of the device.

In accordance with the invention, the target support members each include a laterally extending horizontal section which supports a target in the form of an impact plate in a manner which prevents and/or substantially minimizes harmful bullet splashback that can harm persons on the shooting line or damage to the structure of the rotary target. To this end, in the illustrated embodiment, each target support rod 21 includes a radial section 21*a* connected to the hub 20, a horizontal target supporting section 21*b*, and an angled section 21*c* interconnecting the radial and horizontal sections 21*a*, 21*b*. Each target is in the form of a rectangular or square impact plate 30 made of hardened, impact resistant steel capable of withstanding impact from rifle and handgun bullets. The impact plates 30 in this case are welded to outer radial sides of the horizontal support rod sections 21*b*. Hence, as depicted in FIG. 2, when an impact plate 30 is in an upper position and it is on an upper side of the horizontal support rod section 21*b* and when the impact plate 30 in the lower position it is on an underside of the horizontal support rod section 21*b*.

It will be seen that when an impact plate 30 is in an upper position and a bullet strikes the impact plate at the juncture between the impact plate 30 and the horizontal support rod section 21*b* fragments will tend to be deflected by the support rod section 21 in a substantial vertical direction, in contrast to the prior art in which vertical support rods that support the impact plates deflect bullet splashback laterally in a direction that could affect other shooters on the firing line. The horizontal support rod section 21*b*, when in such upper position, further tends to prevent deflection of the splashback in a downward direction that can damage the stand 11 or the rotary target support structure 12. Likewise, when the impact plate 30 is in a lower position, as depicted in FIG. 2, bullet fragments striking the impact plate 30 at the junction between the impact plate 30 and the horizontal support rod section 21*b* will be deflected downwardly toward the ground, again in a manner which will not cause harmful splashback to participants on the firing line or damage to the structure of the rotary target.

In carrying out a further feature of the invention, the target impact plates 30 are supported by the horizontal support rod sections 21*b* in outward laterally spaced relation to the plane of the radial support rod sections 21*a* for increased horizontal separation between the impact plates 30 and enhanced shooting practice difficulty. In the illustrated embodiment, the impact plates 30 are disposed a distance "x" laterally outwardly of the radial support rod section 21*a* of about one-half the width "w" of the impact plate 30, hence creating a lateral separation corresponding to about the horizontal width "w" of the impact plates 30. It will be seen that rotary target provides more challenging sequential shooting by virtue of the increased horizontal spacing between the impact plates 30 during repetitive alternate shooting.

Figure 5:
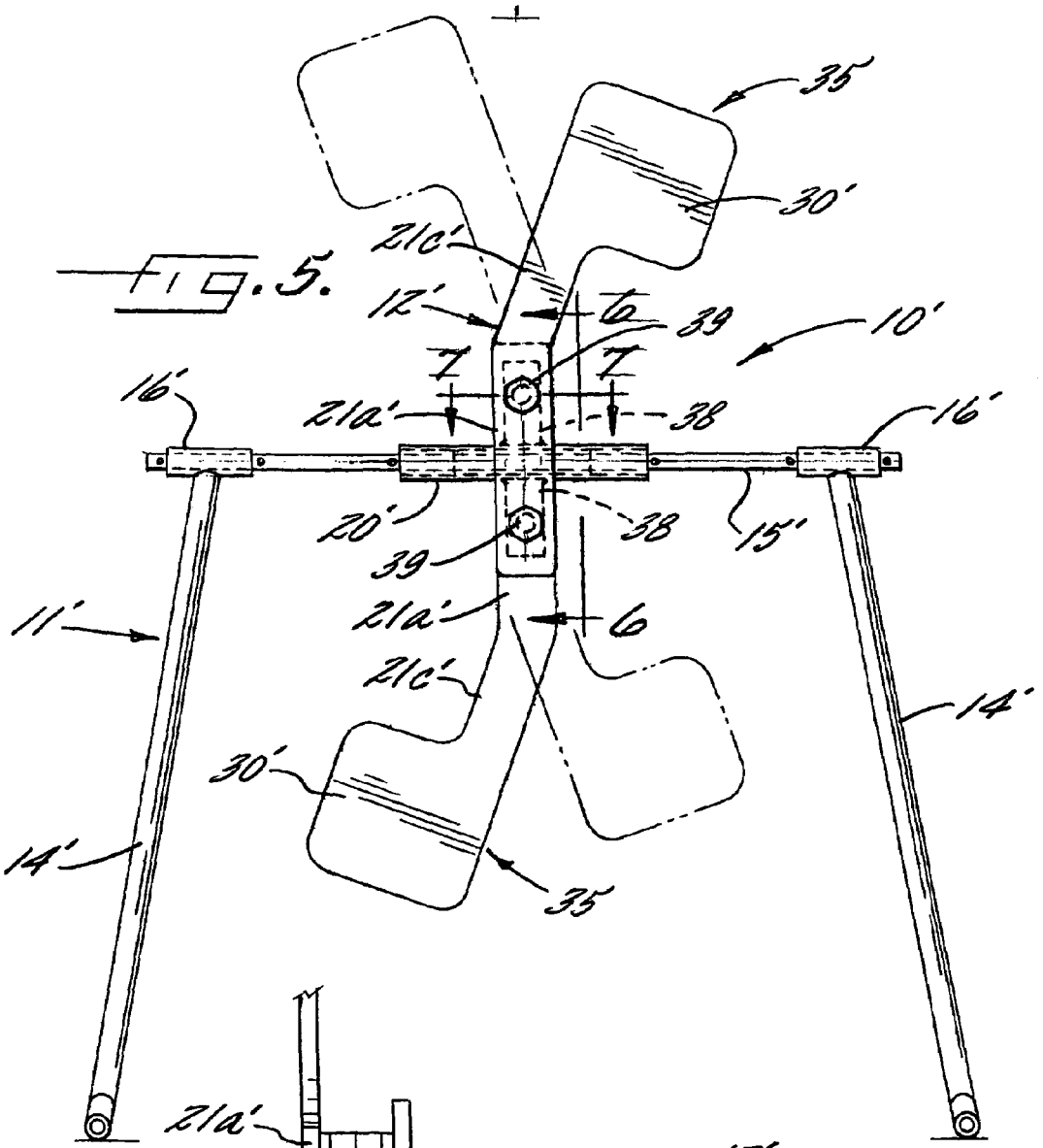
FIG. 5 is a front elevational view of an alternative embodiment of rotary target in accordance with the invention.
Figure 6:
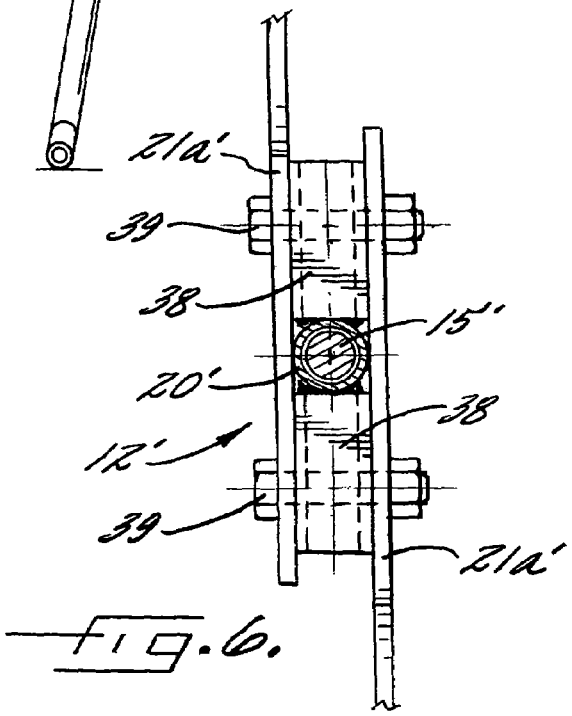
FIG. 6 and FIG. 7 are enlarged fragmentary sections of the rotary target shown in FIG. 5, taken in the planes of lines 6—6 and 7—7 respectively.
Figure 7:
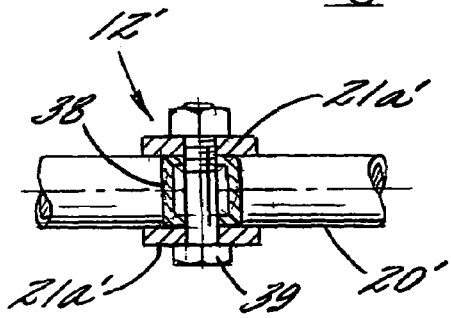

Referring now to FIGS. 5–7, there is shown an alternative embodiment of rotary shooting target in accordance with the invention, wherein items similar to those described above have been given similar reference numbers with the distinguishing "prime" added. The rotary target 10' includes a stand 11' similar to that described above and a rotary target support structure 12' which is adapted for more economical manufacture and even more effective prevention of undesirable bullet splashback. The rotary target support structure 12' again include a hub 20' supported on an axle rod 15' of the stand for relative rotational movement in a vertical plane.

In keeping with this embodiment of the invention, the rotary target includes target impact plate and support structures connected to the rotary hub 20' defined by unitary plates 35 of hardened impact resistant steel. Each plate 35 defines both a generally rectangular impact plate 30' and a support member 21' for supporting the impact plates 30' radially outwardly of the hub 20' in laterally spaced relation to a central radial axis by a distance by at least one-half the width of the impact plates. The support members 21' in this case include a radial plate section 21*a'* coupled to the hub 20' and an inclined plate section 21*c'* interconnecting the radial plate section 21*a'* and the impact plate 30'. The radial plate section 21*a'* of the lower plate depicted in FIG. 5 again is longer than the radial plate section of the upper plate for assuring a neutral vertical position of the target when not in use.

For affixing the target defining plates 35 to the rotary hub 20', tubular members 38 are welded on sides of the hub 20*a'*. The radial plate sections 21*a'* of the target defining plates 35 each are positionable along opposite sides of the tubular members 38 and are secured together and to the channels by removable fasteners in the form of bolts 39.

It will be appreciated by one skilled in the art that since the impact plates 30' and support members 21' are defined by respective unitary, coplanar plates 35, there are no joints, such as the juncture between impact plates and cylindrical support rods, that can increase potentially harmful splashback deflection to persons on the firing line. Since none of the structural members of the rotary support structure 12' necessitate welding, there also are no stress cracks or other weld created defects that can affect the structural integrity of the rotary target at locations that are the subject of repetitive shooting impact. Moreover, since the target defining plates 35 can be easily bolted to the rotary hub 20', the rotary target lends itself to easy manufacture and field assembly.

What is claimed is:

1. A vertical rotary shooting target apparatus comprising:

a stand having a horizontally extending axle;

a target structure mounted on said axle for rotational movement;

said target structure including a mounting hub mounted on the axle for free relative rotation and a pair of target impact plates, each impact plate having a respective support structure which supports a single impact plate for rotational movement with said mounting hub; and said support structures for said impact plates fixedly support the impact plates radially outwardly of said hub on opposite diametrically opposed sides thereof and in laterally offset relation to each other in a direction parallel to the axis of said axle without any other impact plate being disposed at a common lateral position with respect to the mounting hub such that impact upon said impact plates as an incident to shooting will cause rotation of said target structure about said axle with a shooter being required to shoot in laterally-offset directions to shoot different impact plates of the rotary target.

2. The vertical rotary shooting target of claim 1 in which said support structures support said impact plates with a lateral separation between the impact plates in a direction parallel to the axis of said axle of at least one-half of the lateral width of the impact plates.

3. The vertical rotary shooting target apparatus of claim 2 in which said support structures support said impact plates with a lateral spacing of about the horizontal width of said impact plates.

4. The A vertical rotary shooting target apparatus of claim 1 in which each said impact plate and its respective support structure comprising a common plate with a coplanar surface that in part defines a bullet impact face of said impact plate.

5. The vertical rotary shooting target of claim 4 in which each said coplanar plate includes a mounting section, and said plate mounting sections being disposed on opposite sides of said hub and coupled together by removable fasteners.

6. A vertical rotary shooting target apparatus comprising:

a stand having a horizontally extending axle;

a target structure mounted on said axle for rotational movement in a vertical plan about a horizontal axis of said axle;

said target structure including a mounting hub rotatably mounted on the axle and a pair or target impact plates, each impact plate having a respective support structure connected to said mounting hub;

each said impact plate and its respective support structure comprising a common plate with a coplanar surface that in part defines a bullet impact face of said impact plate;

each said common plate including a mounting section, said plate mounting sections being disposed on opposite sides of said hub and coupled together by removable fasteners, and tubular members welded on opposite sides of said mounting hub in interposed relation between the impact plate mounting sections.

7. A vertical rotary shooting target apparatus comprising:

a stand having a horizontally extending axle;

a target structure mounted on said axle for rotational movement in a vertical plane;

said target structure including a mounting hub rotatably mounted on the axle and a pair of target impact plates, a respective support structure connected to said mounting hub fixedly supporting each impact plate on said hub;

said support structures each including mounting portions disposed on opposite sides of said hub and secured together by removable fasteners; and said support structures support said impact plates radially outwardly of said hub on opposite diametrically opposed sides thereof in laterally offset relation to each other in a direction parallel to the axis of said axle such that impact upon said impact plates a an incident to shooting will cause rotation of said target structure about said axle.

8. The vertical rotary shooting target of claim 7 in which said mounting portions are flat plates.

9. The vertical rotary shooting target of claim 8 including tubular members welded to opposite sides of said hub, and said mounting portions are secured to said tubular members by said removable fasteners.

10. The vertical rotary shooting target of claim 9 in which ends of such tubular members are welded in a butting relation on diametrically opposed sides of said hub.

11. A vertical rotary shooting target apparatus comprising:

a stand having a horizontally extending axle;

a target structure mounted on said axle for rotational movement;

said target structure including a mounting hub mounted on the axle and a pair of target impact plates, each impact plate having a support structure connecting the impact plate to said mounting hub;

said support structures for said impact plates fixedly support the impact plates radially outwardly of said hub on opposite diametrically opposed sides thereof and in laterally offset relation to each other in a direction parallel to the axis of said axle such that impact upon said impact plates a an incident to shooting will cause rotation of said target structure about said axle, said supporting structure for each impact plate being a connecting rod, each said connecting rod having a horizontally extending section, and said impact plates each being fixed to an outer radial side of the horizontal connecting rod section in relation to the axle.

12. The vertical rotary shooting target apparatus of claim 11 in which each connecting rod includes a radial section fixed to said hub.

13. The vertical rotary shooting target apparatus of claim 12 in which each said connecting rod includes an intermediate section extending between said radial section and horizontal section at an acute angle to said radial section.

14. A vertical rotary shooting target apparatus comprising:

a stand having a horizontally extending axle;

a target structure mounted on said axle for rotational movement;

said target structure including a mounting hub mounted on the axle and a pair of target impact plates, each impact plate having a support structure connecting the impact plate to said mounting hub;

said support structures for said impact plates fixedly support the impact plates radially outwardly of said hub on opposite diametrically opposed sides thereof and in laterally offset relation to each other in a direction parallel to the axis of said axle such that impact upon said impact plates a an incident to shooting will cause rotation of said target structure about said axle, and each said impact plate and its respective supporting structure comprising a common coplanar plate.

* * * * *